US008517482B2

(12) United States Patent
Carey

(10) Patent No.: US 8,517,482 B2
(45) Date of Patent: Aug. 27, 2013

(54) FRICTION CONTROLLED DRAWER SLIDE MECHANISM

(75) Inventor: Mark R. Carey, Upper Sandusky, OH (US)

(73) Assignee: CVG Management Corporation, New Albany, OH (US)

( * ) Notice: Subject to any disclaimer, the term of this patent is extended or adjusted under 35 U.S.C. 154(b) by 25 days.

(21) Appl. No.: 13/294,658

(22) Filed: Nov. 11, 2011

(65) Prior Publication Data

US 2012/0146473 A1 Jun. 14, 2012

Related U.S. Application Data

(60) Provisional application No. 61/422,488, filed on Dec. 13, 2010.

(51) Int. Cl.
*A47B 88/00* (2006.01)

(52) U.S. Cl.
USPC ..... 312/334.7; 312/331; 312/286

(58) Field of Classification Search
USPC ..... 312/334.6–334.8, 334.44, 286, 331; 384/20
See application file for complete search history.

(56) References Cited

U.S. PATENT DOCUMENTS

| | | | | |
|---|---|---|---|---|
| 1,668,232 | A * | 5/1928 | Coppes | 312/203 |
| 2,815,252 | A | 9/1954 | Baker | |
| 3,078,129 | A * | 2/1963 | Beeck | 384/19 |
| 3,586,394 | A | 6/1971 | Hecksel | |
| 3,679,275 | A * | 7/1972 | Fall et al. | 384/18 |
| 3,966,273 | A * | 6/1976 | Hagen et al. | 384/18 |
| 4,028,949 | A * | 6/1977 | Hagen | 74/25 |
| 4,070,076 | A * | 1/1978 | Zwillinger | 312/350 |
| 4,324,439 | A * | 4/1982 | Hagen et al. | 384/18 |
| 4,600,254 | A * | 7/1986 | Whalen | 312/323 |
| 5,085,524 | A * | 2/1992 | Reiss, Jr. | 384/17 |
| 5,403,097 | A * | 4/1995 | Woof | 384/20 |
| 5,549,377 | A * | 8/1996 | Krivec | 312/334.8 |
| 6,050,628 | A * | 4/2000 | Allison et al. | 296/37.12 |
| 7,249,814 | B2 * | 7/2007 | Hoshide et al. | 312/334.7 |
| 7,946,667 | B2 * | 5/2011 | Schweers et al. | 312/333 |
| 8,152,250 | B2 * | 4/2012 | Aguilar Ante et al. | 312/331 |

(Continued)

OTHER PUBLICATIONS

Blaine R. Copenheaver, Notification of Transmittal of the International Search Report and the Written Opinion of the International Search Authority, or the Declaration, Mar. 16, 2012.

(Continued)

*Primary Examiner* — Hanh V Tran
(74) *Attorney, Agent, or Firm* — Kegler Brown Hill & Ritter; James J. Pingor

(57) ABSTRACT

A friction controlled mechanism for use on a cabinet assembly is provided. The cabinet assembly includes a stationary structure such as a cabinet, a moveable structure such as a drawer that is moveable in relation to the stationary structure and the friction controlled mechanism. The friction controlled mechanism is attached to each side of the moveable structure. The friction controlled mechanism includes a frame member with a length and a friction based flexible member. The flexible member is wrapped around a perimeter of the frame member such that the flexible member is capable of traveling in opposite directions around the perimeter of the frame member during movement of the moveable structure toward and away from the stationary structure. The flexible member imparts a friction to side rails of both the stationary structure and the moveable structure to provide a controlled stable movement of the moveable structure.

19 Claims, 5 Drawing Sheets

(56) References Cited

U.S. PATENT DOCUMENTS

| | | | | |
|---|---|---|---|---|
| 2008/0211365 | A1* | 9/2008 | Moll et al. | 312/319.1 |
| 2009/0257692 | A1 | 10/2009 | Sattler | |
| 2009/0261698 | A1 | 10/2009 | Cabal et al. | |
| 2010/0219727 | A1 | 9/2010 | Aguilar Ante et al. | |

OTHER PUBLICATIONS

Blaine R. Copenheaver, Notification of Transmittal of the International Search Report and the Written Opinion of the International Search Authority, or the Declaration, May 29, 2012.

* cited by examiner

FRICTION CONTROLLED DRAWER SLIDE MECHANISM

CROSS-REFERENCE TO RELATED APPLICATIONS

This application claims the benefit of U.S. Provisional Patent application Ser. No. 61/422,488 entitled "CRAWLER TRACK DRAWER SLIDE" and filed on Dec. 13, 2010.

ORIGIN

The innovation disclosed herein relates to cabinet design and more specifically to a friction controlled mechanism such as a slide assembly to provide a stable movement of a moveable structure such as a drawer in a cabinet.

BACKGROUND

In the field of cabinet design, and more particularly to slide assemblies or drawer guides, conventional slide assemblies utilize heavy steel roller designs, which have limitations and are expensive. Thus, conventional steel roller designs not only increase cost but also add unnecessary weight to the cabinet. In addition, conventional steel drawers with steel sliders typically have a catch because they do not integrate any translation movement. The conventional steel units simply rely on the fact that if they travel the full extension before they begin to bring the rolling member out they are strong enough all the way through that motion until such time as they engage the second slider. Thus, conventional steel sliders are overdesigned by purpose to work on the cantilever forces imparted.

In addition, in transportation vehicle-based cabinet product lines, conventional steel roller bearing designs employ a near zero friction roller bearing design. This allows the drawer to inadvertently open due to the shifting of inertia in the drawer caused by the movement of the vehicle.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

The innovation disclosed and claimed herein, in one aspect thereof, comprises a friction controlled mechanism for use on a cabinet assembly. The cabinet assembly includes a stationary structure such as a cabinet, a moveable structure such as a drawer that is moveable in relation to the stationary structure and the friction controlled mechanism. The friction controlled mechanism is attached to each side of the moveable structure. The friction controlled mechanism includes a frame member with a length and a friction based flexible member. The flexible member is wrapped around a perimeter of the frame member such that the flexible member is capable of traveling in opposite directions around the perimeter of the frame member during movement of the moveable structure toward and away from the stationary structure. The flexible member imparts a friction to side rails of both the stationary structure and the moveable structure to provide a controlled stable movement of the moveable structure.

In accordance with another aspect of the innovation, the flexible member has frictional properties that facilitate a controlled stable movement of the moveable structure when a minimal force is applied to the moveable structure while simultaneously preventing the moveable structure from moving when a force exerted on the moveable structure is less than the minimal force.

In accordance with yet another aspect of the innovation, a method of assembling a friction controlled mechanism for use on a cabinet assembly is provided. The method includes providing a frame member, providing a flexible member, wrapping the flexible member around a perimeter of the frame member such that the flexible member is free to travel around the perimeter of the frame member in opposite directions, and attaching a stop to the frame member.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1A:
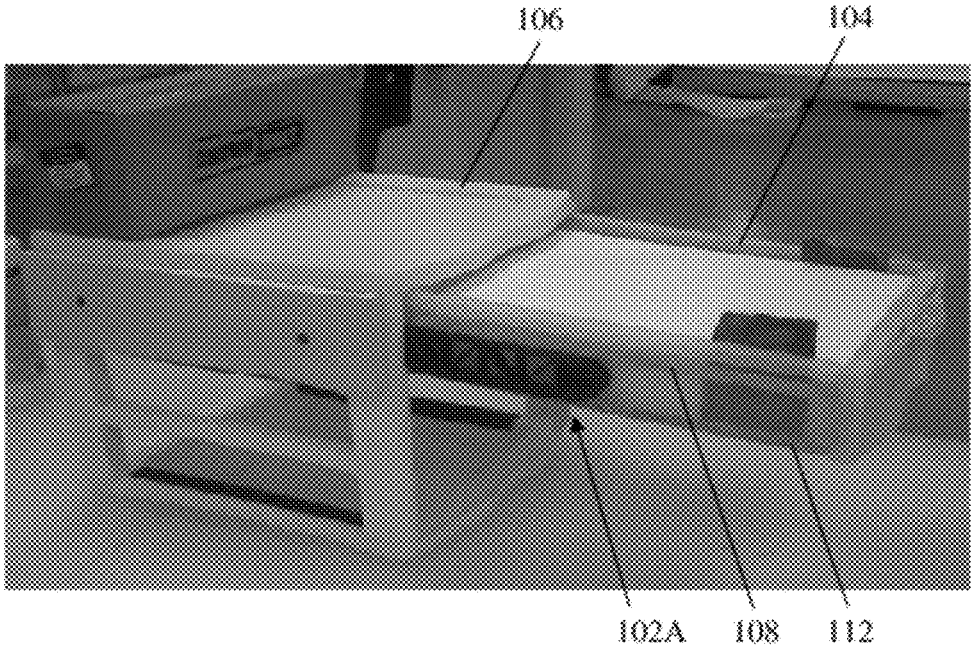
FIG. 1A illustrates a left side perspective view of a drawer assembly incorporating a friction controlled mechanism in accordance with aspects of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

Figure 1B:
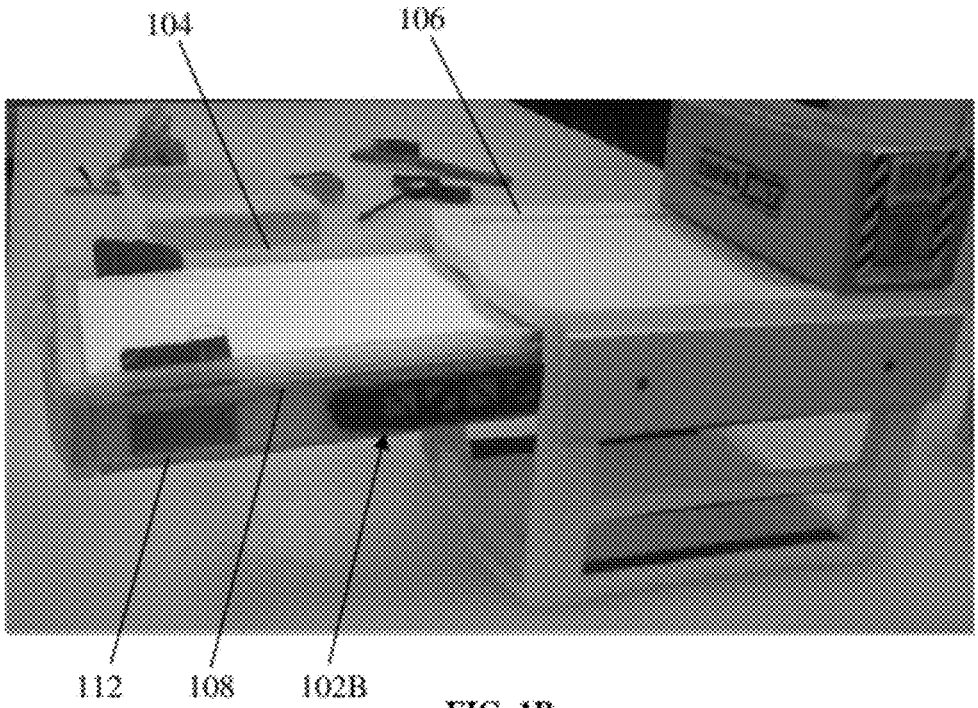
FIG. 1B illustrates a right side perspective view of a drawer assembly incorporating the friction controlled mechanism in accordance with aspects of the innovation.

Referring now to the drawings, FIGS. 1A and 1B are left and right perspective views respectively of a cabinet assembly system 100 incorporating a friction controlled mechanism 102, such as but not limited to an example drawer slide assembly 102A, 102B (collectively "slide assembly 102") in accordance with aspects of the innovation. It is to be appreciated that while the example embodiment of the innovation described herein and shown in the figures is in association with a drawer assembly type cabinet, the features, functions and benefits of the innovation can be applied to countless other uses and applications. Some uses and applications within the scope of the innovation include, but not limited to, transportation vehicle-based cabinet product lines for drawers and moving work surfaces, consumer home cabinetry industry (e.g., kitchen and bathroom cabinets), consumer and industrial cabinetry industry (e.g., tool cabinets, platforms, bins, etc.), consumer and industrial moveable work surfaces, doors, etc., and the automotive moving storage market, such as, a bin/drawer/cup holder/etc. Essentially, most any consumer and industrial market that employs controlled cantilevered movement between two members (e.g., vertical lifts, horizontal beam devices, moving trays) can benefit from the innovation described herein. Similarly, general purpose or specialized applications of the cabinetry (or other) industry can employ the features, functions and benefits of the innovation. Thus, the embodiment described herein and shown in the figures, along with the above applications, are for illustrative purposes only, and are not intended to limit the scope of the innovation.

Referring again to FIGS. 1A, 1B, and 2-5, in one example embodiment, the cabinet assembly 100 includes a moveable structure 104 and a stationary structure 106. The moveable structure 104 can be any moveable structure including, but not limited to, a drawer, an extendable platform (work surface), a door, etc. The stationary structure 106 may be any stable structure including, but not limited, a cabinet, a wall, door frame, etc. The term "stationary" does not exclusively refer to a rigid non-moveable structure. "Stationary," as used herein, refers to a stable structure that remains stationary when the moveable structure 104 is operated. In some applications, the stationary structure 106 can itself be moveable, such as a consumer dresser, a mobile tool chest or the like. In addition, in some aspects, one or both of the moveable structure 104 and the stationary structure 106 can be made from plastic, wood, metal, composite, alloy, or the like. Reaction Injection Molding (RIM) or other injection molding techniques can be employed to manufacture the structures 104, 106.

The moveable structure 104 includes a moveable upper side rail 108 having a first moveable surface 110 and a moveable lower side rail 112 having a second moveable surface 114 located on each outer side 116 of the moveable structure 104. The upper and lower moveable side rails 108, 112 are substantially parallel to each other.

The stationary structure 106 includes a stationary upper side rail 118 having a first stationary surface 120 and a stationary lower side rail 122 having a second stationary surface 124 (best shown in FIG. 2) attached on each inner side 126 of the stationary structure 106. The upper and lower stationary side rails 118, 122 are substantially parallel to each other. The moveable upper and lower side rails 108, 112 and the stationary upper and lower side rails 118, 122 cooperate with the slide assembly 102 to facilitate a sliding motion of the moveable structure 104 within an opening 128 of the stationary structure 106. Thus, the moveable structure 104 is slidably moveable within the opening 128 of the stationary structure 106.

Figure 4:
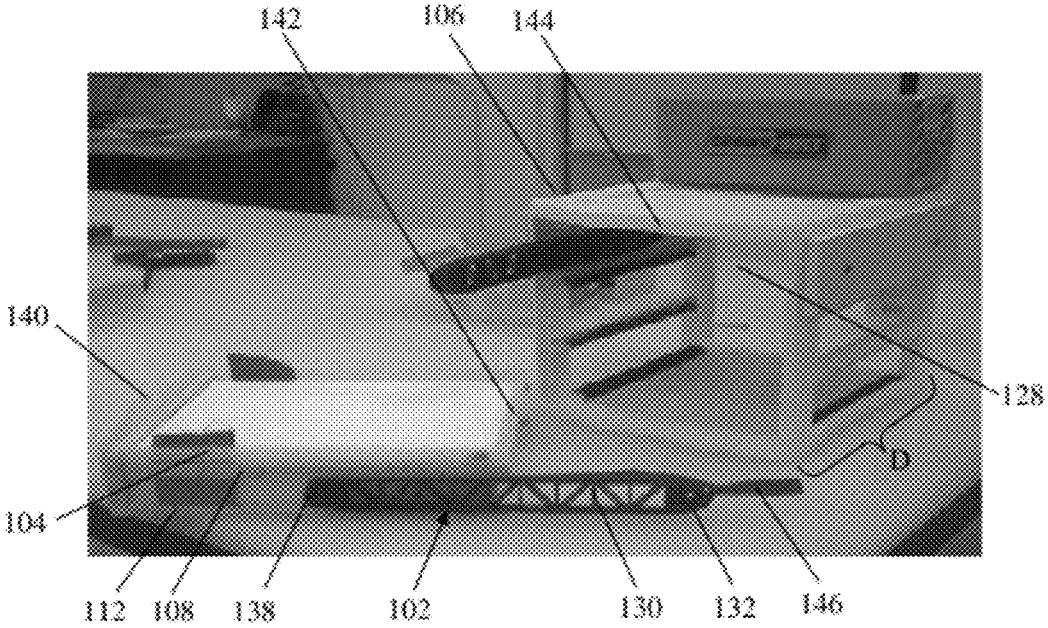
FIG. 4 illustrates a disassembled perspective view of the drawer assembly of FIGS. 1A and 1B in accordance with aspects of the innovation.
Figure 5:
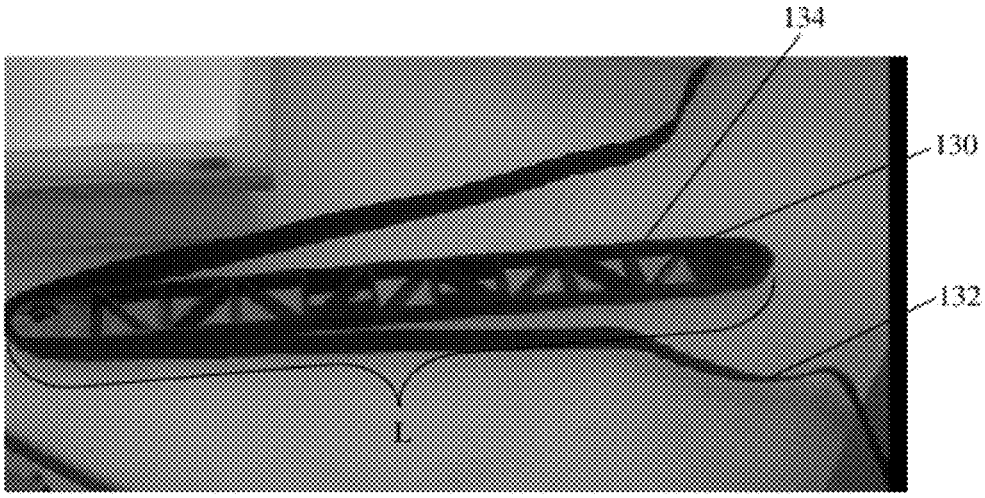
FIG. 5 illustrates a disassembled perspective view of the friction controlled mechanism in accordance with aspects of the innovation.

The slide assembly 102 includes a frame member 130 and a flexible member 132, shown unassembled in FIG. 5. The flexible member 132 is slidably attached (FIGS. 1A, 1B, and 2-4) around a perimeter 134 (see also FIG. 5) of the frame member 130. The flexible member 132 is not fixedly attached to the frame member 130 such that the flexible member 132 cannot move. Rather, during operation of the moveable structure 104, the flexible member 132 travels around the perimeter 134 of the frame member 130 while simultaneously being constrained to remain on a surface of the perimeter 134 of the frame member 130.

The frame member 130 can be made from a flexible material to allow the frame member 130 to configure to a contour generated by the moveable upper and lower rail 108, 112. On the other hand, the flexible member 132 can be more rigid and have a more permanent shape. Thus, the flexible member 132 can be made from any suitable material such as but not limited to plastic, wood, metal, composite, alloy, or the like.

The flexible member 132 has frictional properties that facilitate a controlled-stable sliding motion of the moveable structure 104 into and out of the stationary structure 106 with minimal force. On the other hand, the flexible member 132 has frictional properties that prevent the moveable structure 104 from inadvertently moving into and out of the stationary structure 106 when a force applied to the moveable structure 104 is less than the minimal force. Such a force may be due to inertia caused by, for example, the movement of a vehicle in the case of transportation vehicle-based cabinet product lines. Thus, the flexible material can be any material capable of providing a controlled friction movement having the frictional properties mentioned above, such as but not limited to, a hook material, a loop material or a combination thereof, a web type material, roller chain, etc. It is to be appreciated that the use of hook and hook/loop materials employ tolerance absorbing characteristics that can be used in applications different from those described herein. These alternative materials and applications are to be included within the scope of the specification and claims appended hereto.

Figure 2:
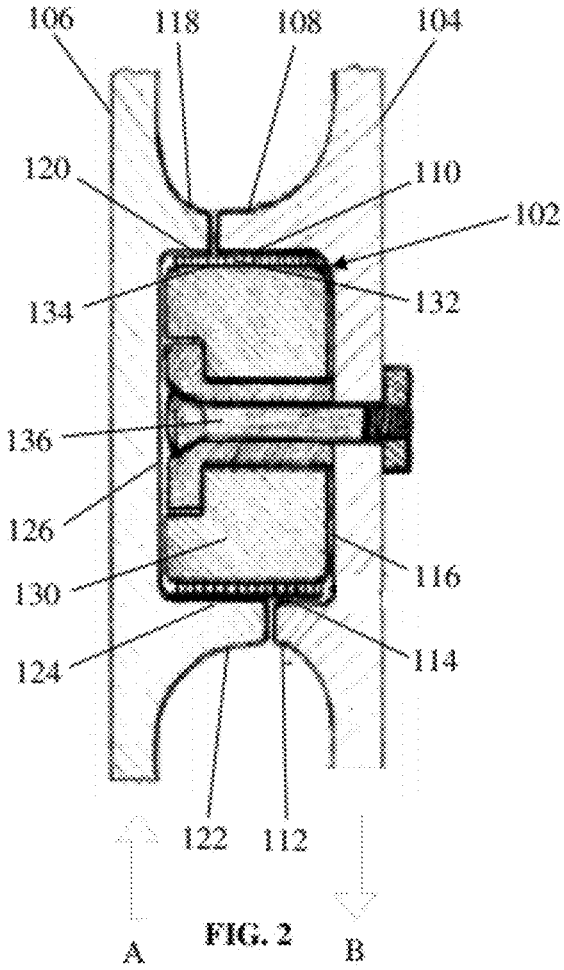
FIG. 2 illustrates a cross-sectional view of the friction controlled mechanism of FIGS. 1A and 1B in accordance with aspects of the innovation.
Figure 3:
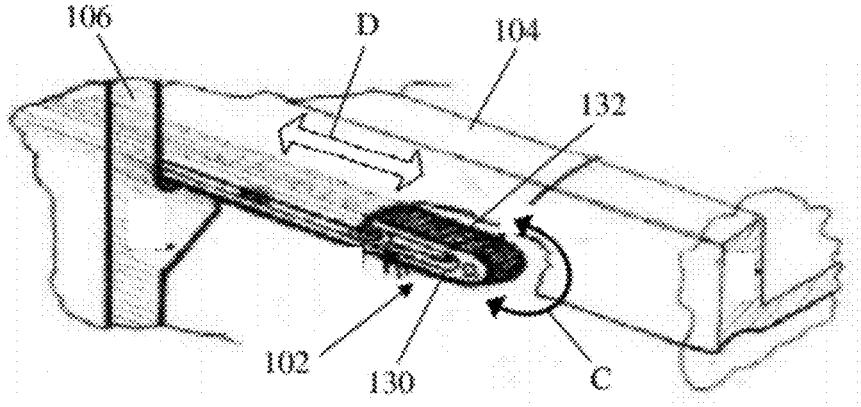
FIG. 3 illustrates a perspective view of the friction controlled mechanism in accordance with aspects of the innovation.

Referring to FIGS. 2-4, the slide assembly 102 is attached to each outer side 112 of the moveable structure 104 between the moveable upper side rail 108 and the moveable lower side rail 110. The slide assembly 102 can be attached by either simply sandwiching the slide assembly 102 between the moveable upper and lower rails 108, 112 or it can be attached to the outer side 112 with one or more optional fastener elements 136, such as but not limited to a screw, a rivet, etc. The fastener elements 136 are configured to absorb side, vertical, and tensile loads.

When attached to the moveable structure 104, the flexible member 132 is in contact with the first moveable surface 110 of the moveable upper side rail 108 and the second moveable surface 114 of the moveable lower side rail 112. Further, when attached, the slide assembly 102 is situated such that a front 138 of the slide assembly 102 is disposed approximately halfway between a front 140 and a rear 142 of the moveable structure 104. Thus, approximately half of the slide assembly 102 extends beyond the rear 142 of the moveable structure 104. As a result, when the moveable structure 104 is in a fully extended or open position, as shown in FIGS. 1A and 1B, no more than approximately half of the slide assembly 102 extends beyond a front 144 of the stationary structure 106. This arrangement provides maximum cantilevered support thereby minimizing a downward tilting of the moveable structure 104 when in the fully extended or open position. Other advantages regarding the arrangement are discussed further below.

Referring back to FIGS. 1A, 1B, and 2, when the moveable structure 104 is inserted into the opening 128 of the stationary structure 108, the flexible member 132 is in contact with the first stationary surface 120 of the stationary upper side rail 118 and the second stationary surface 124 of the stationary lower side rail 122. Thus, as best shown in FIG. 2, the slide assembly 102 is "sandwiched" in a horizontal direction between the outer side 116 of the moveable structure 104 and the inner side 126 of the stationary structure 106 and in a vertical direction between the first moveable surface 110 and the second moveable surface 114, and the first stationary surface 120 and the second stationary surface 124.

This arrangement helps distribute loads between the moveable structure 104 and the stationary structure 106. Specifically, as shown in FIG. 2, arrow "A" indicates a direction of a major load resistance force upon the stationary structure 106. Similarly, arrow "B" indicates a direction of a major load resistance force upon the moveable structure 104. The arrangement of the slide assembly 102 distributes the loading action between the moveable structure 104 and stationary structure 106 to thereby minimize loads and stresses between moveable structure 104 and stationary structure 106.

The slide assembly 102 further includes a stop 146 that prevents over extension of the moveable structure 104 from the stationary structure 106 (see FIG. 4). In the embodiment shown in FIG. 4, the stop 146 is a strap that attaches to a rear of the slide assembly 102 and to a rear portion of the stationary structure 106, once the moveable structure 104 is inserted into the opening 128 of the stationary structure 106. It is to be appreciated, however, that the stop 146 and functionality thereof can be comprised of pins, a catch, bracket, or any other type of stop without departing from the scope of the innovation.

During operation of the moveable structure 104 into and out of the stationary structure 106, the flexible member 132, due to a pressure from each moveable side rail 108, 112 and each stationary side rail 118, 122, imparts a friction to each of the first moveable surface 110, second moveable surface 114, first stationary surface 120, and second stationary surface 124. The friction causes the flexible member 132 to travel around the frame member 130 in the direction of the double sided arrow "C" depending on the direction of the moveable structure 104 indicated by the double sided arrow "D." Thus, the flexible member 132 can travel in opposite directions around the perimeter 134 of the frame member 130. The stop 146 limits the travel of the moveable structure 104 out of the opening 128 of the stationary structure 106.

The example slide assembly 102 described above coupled with the friction properties of the flexible member 132 provides a controlled-stable movement of the moveable structure 104 into and out of the stationary structure 106. Further, the slide assembly 102 provides a load/force bearing to the stationary structure 106. Still further, the slide assembly 102 provides positive vertical and supplementary horizontal and translational force/load control. As mentioned above, the slide assembly 102 also provides maximum cantilevered support thereby minimizing a downward tilting of the moveable structure 104 with respect to the stationary structure 106 when in the fully extended or open position. Still yet another advantage to the innovation is that the slide assembly 102 provides a "distributed" loading of the action between the moveable structure 104 and the stationary structure 106 attached in a "cantilevered" configuration.

Figure 6:
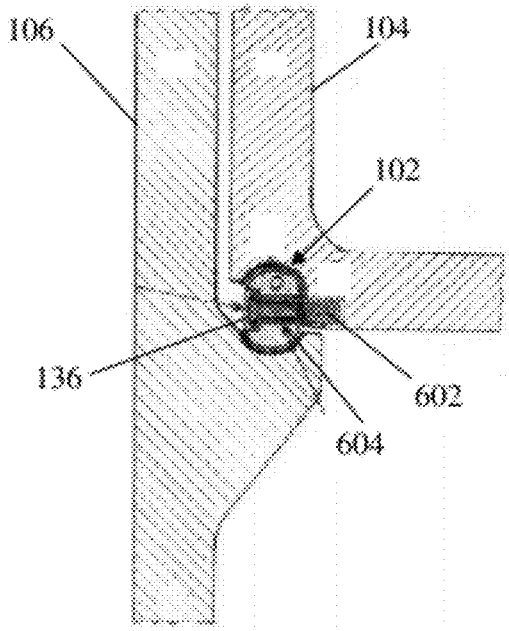
FIG. 6 illustrates a modified embodiment of the friction controlled mechanism in accordance with aspects of the innovation.

In an alternative example embodiment shown in FIG. 6, a load distribution fastener attachment element 602 can be used to transfer with distribution the load between the fastener element 136 and the moveable structure 104. In addition, a rolling bearing element 604 can be used to provide an "anti-friction" roller action between the fastener element 136 and the slide assembly 102.

Figure 7:
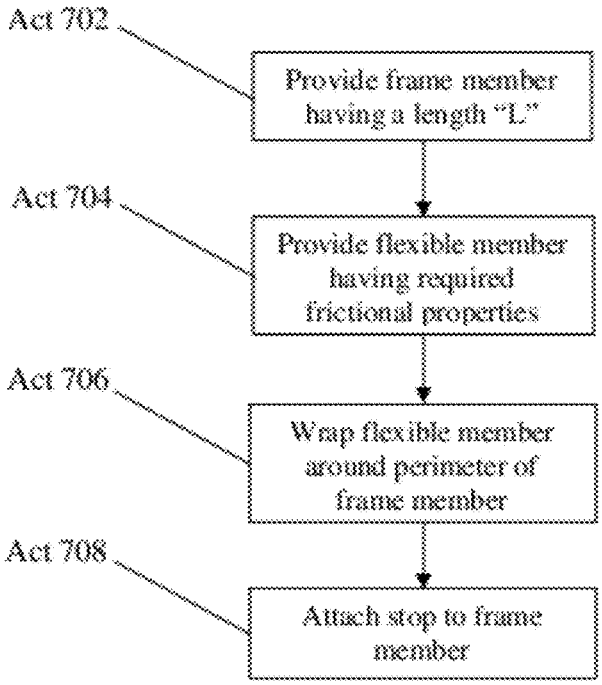
FIG. 7 illustrates an example method of assembling the friction controlled mechanism of FIGS. 1A and 1B in accordance with aspects of the innovation.

Referring to FIG. 7, a method of assembling the above described slide assembly 102 with reference to FIGS. 4 and 5 is disclosed. At Act 702, a frame member 130 is provided. The frame member 130 has a length "L" that is less than a depth "D" of the stationary structure 106. As mentioned above, the frame member 130 can be flexible or rigid and can be made from any suitable material, such as but not limited to, plastic, wood, metal, composite, alloy, or the like. At Act 704, the flexible member 132 is provided that has the frictional properties described above. At Act 706, the flexible member 132 is wrapped around the perimeter 134 of the frame member 130 such that the flexible member 132 is free to travel around the perimeter 134 of the frame member 130. At Act 708, the stop 146 is applied to the frame member 130 in the form of a strap, pin, catch, etc. The slide assembly 102 is then attached to the moveable structure 104 and implemented as described above.

Figure 8:
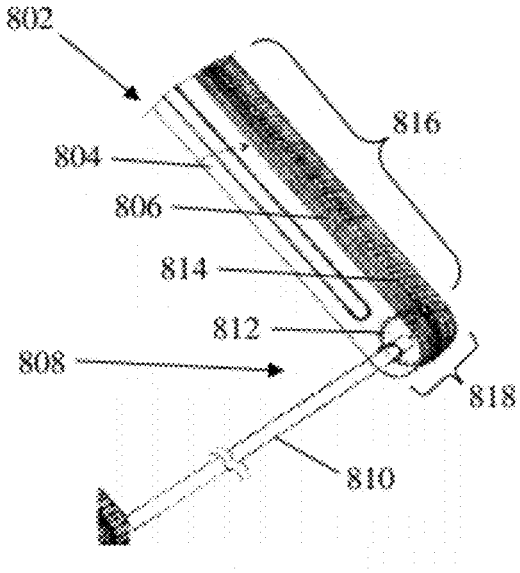
FIG. 8 illustrates an alternate embodiment that connects more than one friction controlled mechanisms with an axel or shaft in accordance with aspects of the innovation.

In still yet another example embodiment shown in FIG. 8, one or more substantially parallel slide assemblies 802 having a frame member 804 and a flexible member 806 can be operated via a drive mechanism 808. The drive mechanism 808 includes an axel 810, a gear 812 attached to each end of the axel 810, and a chain 814. The drive mechanism 808 provides synchronized movement, braking, and centering of the flexible member 806 for each slide assembly 802. In addition, a curved surface 816 of the frame member 804 beneath the flexible member 806 acts against the chain 814. The curved surface 816 provides a lateral force resistance against the flexible member 806 to keep the flexible member 806 centered. A flat surface 818 of the frame member 804 assists to change the direction and align the flexible member 806. It is to be appreciated that while the example drive mechanism shown in FIG. 8 includes an axel, gears and chain, other similar functioning drive mechanisms are that enable synchronization of the slide mechanisms are to be included within the scope of the innovation and claims appended hereto.

Figure 9:
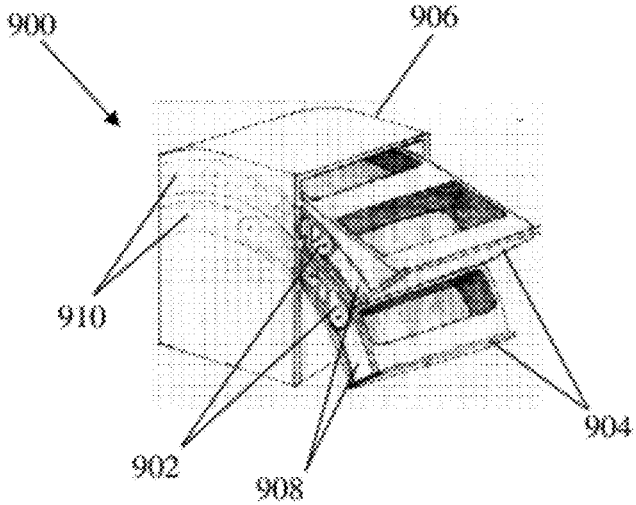
FIG. 9 illustrates an alternate example embodiment of a drawer assembly incorporating an alternate embodiment of the friction controlled mechanism having a curved or arched configuration in accordance with aspects of the innovation.

FIG. 9 is a perspective view of an alternate cabinet assembly 900 incorporating another example embodiment of a friction controlled mechanism 902. The cabinet assembly 900 is similar to the embodiment described above in that it includes one or more moveable structures 904 and a stationary structure 906 and employs the aforementioned features, functions and benefits of the innovation above. The main difference between the embodiment described above and the embodiment shown in FIG. 9 is that the one or more moveable structures 904 move in a curved or arched motion. Thus, the friction controlled mechanism 902 is curved or arched to conform to curved or arched channels 908, 910 of the one or more moveable structures 804 and the stationary structure 806. The friction controlled mechanism 902 can be either flexible in that it conforms itself to the contour of the curved or arched channel 908, 910 of the one or more moveable structures 904 and the stationary structure 906 respectively or it can be more rigid and have a more permanent curved or arched shape.

The embodiment shown in FIG. 9 can be especially useful for overhead or raised height designed drawer assemblies. For example, a user can reach to pull down the drawer which is frictionally controlled the friction controlled mechanism 902. Thus, items within the moveable structure 904 can be presented in a vertical or near vertical orientation thereby enabling a user to reach and/or view the items. Latches, catches, locks, etc. are contemplated and can be employed when and where appropriate or desired. It is to be appreciated that the one or more moveable structures 904 can be connected by a common axel and driven simultaneously with a drive mechanism similar to the one described above. As the embodiment in FIG. 9 illustrates, the shape, size and/or configuration of the moveable and stationary structures and friction controlled mechanism described above can vary without departing from the features, functions and benefits of the innovation. These variations are to be included within the scope of this disclosure and claims appended hereto.

For example, the innovation described herein can be used in a two-way moveable structure application. For example, an extendable platform (work surface) and/or drawer can move in two directions to opposite sides of a cabinet or a kitchen island. Thus, the moveable structure could be a double sided drawer where the user could access the drawer from opposite sides of the cabinet or island. Whereas, conventional steel sliders include stops that prevent two way directional operation.

In other aspects, the innovation can be employed on moveable structures having a curved (or arched) motion. For example, in this aspect, drawers can be placed or positioned above a user's height whereby, when opened, the drawers move in a downward curved direction for easy accessibility. It will be appreciated that some aspects can employ a latch, catch, lock or other preventative opening system as desired. It should be noted that in some aspects, the movement of the moveable structure can be in an upward direction.

Another aspect can employ dual movement/telescopic moveable structures such as but not limited to work surfaces. It is to be understood and appreciated that the depth of moveable structures can vary, thus, the innovation is not limited to the size of the moveable structure.

Still other aspects can employ one or more slide assemblies driven with a drive mechanism. The drive mechanism can include an axel, gear, and chain configuration, which can be adapted to include a motor to drive the moveable structure. This mechanically or electrically powered motion can assist, for example, with heavy loads and effect remote power to place items in an accessible position or reach of a user.

In yet other aspects, the innovation can be employed as a center-less hinge pivot that is capable of having an off-set mounting surface with a common aligned rotational axis point. In application, the zero point or the axle point of the hinge is in space as open space. Thus, if the innovation is used as a hinge for a door and the door translates and rotates at the same time, one can design a hinge point for a curved door that has no traditionally conceivable mounting surfaces in common in plane. Normally, this would mean that one would have a door that would pivot up at an angle or down at an angle. Alternatively, spacers would have to be used on the door to keep it all on the same hinge plane which makes for extra weight, extra load, and extra cantilevering forces. However, using various upper, mid or lower circular arch dimensions, the innovation can align "non-planer" mounting surfaces to act on a common "in-space" axis point using the center-less device.

Thus, in accordance with the innovation, one can put direct forces on the door at the door hinge off of the inside, one at the top, one at the bottom and even one in the middle. All three of the slide assemblies can be on different mounting points prescribed around the same hinge point, e.g., desirable tilt, non-desirable tilt, flat, etc. This can be accomplished in space simply by changing the arc radius on each of the other hinges. It would not matter if the door was curved or unconventionally (non-planer) shaped. Rather, the mounting surfaces could be as variable as desired.

While many of the aspects described herein refer to a horizontal orientation, it is to be understood that other aspects can employ the slide assembly in a vertically mounted arrangement with a slide assembly at the top and a slide assembly at the bottom. Here, if the slide assemblies are equipped with a gear(s) having an axle in the back, racking can be alleviated and/or eliminated. Thus, even though there is a cantilever load in the worst possible condition, the fact that the slide assemblies are tied together means that the top will not allow the bottom to rack more than the tolerance that is built into the system. Essentially, the slide assemblies not only can be used in a horizontal mode, but can also be used in a vertical mode.

In all, it is to be appreciated that the slide assembly can employ a flexible member made of most anything that actually allows for bearing the friction that is intended to be beared, translating a member that is intended to be translated and moving in a back and forth motion in a smooth, normal fashion while maximizing load distribution (e.g., utilizing half in, half out slide assembly design).

It is to be appreciated that aspects of the innovation can employ a dampener, a spring loaded device or a power device that can assist in motion and/or counter force as required or desired.

In addition, conventional steel drawers with steel sliders typically have a catch because they do not integrate any translation movement. The traditional steel units simply rely on the fact that if they travel the full extension before they begin to bring the rolling member out they are strong enough all the way through that motion until such time as they starting bringing the second member of the slider out. Thus, traditional steel sliders are overdesigned by purpose to work on the cantilever forces imparted. In contrast, the innovation described herein offers more robustness. Specifically, the innovation discloses a notion of applying a translation motion while bearing on an integral system for load distribution of an overhanging cantilever device. In operation, the slide assembly can retain aligned position, half in and half out, relative to the maximum utility of the design of some sliders, some conventional sliders interface on both ends of the cantilever.

It will be appreciated that the innovative slide assembly can control friction by design. This is particularly useful in transportation (e.g., long-haul truck) applications. For example, by design, friction can be controlled such that it can be essentially constant regardless of weight or contents of a drawer. Another benefit of a controlled friction mechanism is preventing the inadvertent opening of a drawer in a moving truck due to inertia caused by the moving truck. Conventional roller bearing designs employ a near zero friction roller bearing design, which allows the drawer to inadvertently open due to the shifting of inertia in the drawer caused by the movement of the truck. The controlled friction of the innovation alleviates this condition.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cabinet assembly comprising:

a stationary structure;

a moveable structure moveable in relation to the stationary structure; and a friction controlled mechanism including:

a frame member having a length and attached to each side of the moveable structure via one or more fasteners; and a friction based flexible member slidably wrapped around a perimeter of the frame member such that the flexible member travels in opposite directions around the perimeter of the frame member during movement of the moveable structure toward and away from the stationary structure, the flexible member being in contact simultaneously with an upper moveable side rail and a lower moveable side rail disposed on each outer side of the moveable structure, and an upper stationary side rail and a lower stationary side rail disposed on each inner side of the stationary structure, wherein the flexible member imparts a friction to the upper and lower stationary side rails and to the upper and lower moveable side rails of the moveable structure to provide a controlled stable movement of the moveable structure.

2. The cabinet assembly of claim 1, wherein the flexible member has frictional properties that facilitate a controlled stable movement of the moveable structure when a minimal force is applied to the moveable structure while simultaneously preventing the moveable structure from moving when a force exerted on the moveable structure is less than the minimal force.

3. The cabinet assembly of claim 2, wherein the moveable structure is moveable away from the stationary structure in two directions such that the moveable structure passes through the stationary structure in two directions such that the moveable structure is accessible from opposite sides of the stationary structure.

4. The cabinet assembly of claim 3, wherein the moveable structure is a drawer and/or an extendable platform and the friction controlled mechanism is a slide assembly.

5. The cabinet assembly of claim 4, wherein the flexible member is made from one of a hook material, a loop material, hook/loop material, a web type material, or a chain.

6. The cabinet assembly of claim 1, wherein the friction controlled mechanism is disposed between the upper moveable side rail and the lower moveable side rail on each outer side of the moveable structure such that the friction controlled mechanism contacts a first moveable surface and a second moveable surface of the moveable structure, and a first stationary surface and a second stationary surface of the stationary structure.

7. The cabinet assembly of claim 6, wherein the friction controlled mechanism is attached to the moveable structure such that a front of the friction controlled mechanism is approximately half between a front and a rear of the moveable structure.

8. The cabinet assembly of claim 7, wherein approximately half of the friction controlled mechanism extends beyond the rear of the moveable structure.

9. The cabinet assembly of claim 8, wherein the friction controlled mechanism further includes a stop to limit the travel of the moveable structure away from the stationary structure.

10. The cabinet assembly of claim 9, wherein the length of the frame member is less than a depth of the stationary structure.

11. The cabinet assembly of claim 10, wherein the one or more fasteners including a bearing to provide anti-friction movement between the one or more fasteners and the friction controlled mechanism.

12. The cabinet assembly of claim 1, wherein the friction controlled mechanism on each side of the moveable structure are interconnected via a shaft to provide synchronized movement of the friction controlled mechanisms.

13. The cabinet assembly of claim 12 further comprising a drive mechanism including a gear and a chain interconnected to the shaft to mechanically or electrically drive the interconnected friction controlled mechanisms.

14. The cabinet assembly of claim 1, wherein the moveable structure moves in a curved motion, wherein the moveable structure includes a curved channel on each outer side and the stationary structure include curved channels on each inner side, and wherein the friction controlled mechanism conforms to the configuration of the curved channels of the moveable structure and the stationary structure.

15. The cabinet assembly of claim 14, wherein the friction controlled mechanism is flexible to allow it to conform to a contour of the curved channels or is more rigid and has a more permanent curved shape.

16. A cabinet assembly comprising:

a stationary structure;

a moveable structure moveable in relation to the stationary structure; and a friction controlled mechanism including:

a frame member having a length and attached to each side of the moveable structure via one or more fasteners; and a friction based flexible member slidably wrapped around a perimeter of the frame member such that the flexible member travels in opposite directions around the perimeter of the frame member during movement of the moveable structure toward and away from the stationary structure, the friction controlled mechanism being in contact simultaneously with a first moveable surface and a second moveable surface of the moveable structure, and a first stationary surface and a second stationary surface of the stationary structure, wherein the flexible member has frictional properties that facilitate a controlled stable movement of the moveable structure when a minimal force is applied to the moveable structure while simultaneously preventing the moveable structure from moving when a force exerted on the moveable structure is less than the minimal force.

17. The cabinet assembly of claim 16 further comprising an upper stationary side rail that includes the first stationary surface and a lower stationary side rail a that includes the second stationary surface located on each inner side of the stationary structure, the upper stationary side rail and the lower stationary side rail being substantially parallel to each other, and a moveable upper side rail that includes the first moveable surface and a moveable lower side rail that includes the second moveable surface located on each outer side of the moveable structure, the upper moveable side rail and the lower moveable side rail being substantially parallel to each other.

18. A method of assembling a friction controlled mechanism for use on a cabinet assembly comprising:

providing a frame member attached to teach side of a moveable structure via one or more fasteners;

providing a flexible member;

wrapping the flexible member around a perimeter of the frame member such that the flexible member is free to travel around the perimeter of the frame member in opposite directions and such that the flexible member is in contact simultaneously with an upper moveable side rail and a lower moveable side rail disposed on each outer side of the moveable structure, and an upper stationary side rail and a lower stationary side rail disposed on each inner side of a stationary structure; and attaching a stop to the frame member.

19. The method of claim 18, wherein the flexible member has frictional properties that facilitate a controlled stable movement of the moveable structure in relation to the stationary structure of the cabinet assembly when a minimal force is applied to the moveable structure while simultaneously preventing the moveable structure from moving when a force exerted on the moveable structure is less than the minimal force.

* * * * *